United States Patent [19]

Bales et al.

[11] Patent Number: 4,787,818

[45] Date of Patent: Nov. 29, 1988

[54] CENTRIFUGAL BLOWER ASSEMBLY

[75] Inventors: Michael E. Bales, New Palestine; Michael McKinney; Craig A. Sawyer, both of Indianapolis, all of Ind.

[73] Assignee: Jenn Industries, Inc., Indianapolis, Ind.

[21] Appl. No.: 78,414

[22] Filed: Jul. 27, 1987

[51] Int. Cl.[4] ..... F04D 29/42

[52] U.S. Cl. ..... 415/219 C; 248/544; 29/156.8 CF

[58] Field of Search ..... 415/203, 204, 205, 206, 415/219 C, 201; 248/544, 639, 666, 672; 29/156.8 CF, 513

[56] References Cited

U.S. PATENT DOCUMENTS

| | | | |
|---|---|---|---|
| 2,015,210 | 9/1935 | Witzel | 415/219 C |
| 2,215,318 | 9/1940 | Bristol | 29/513 |
| 2,482,519 | 9/1949 | Schwarz | 415/219 C |
| 2,711,682 | 6/1955 | Drechsel | 98/43 |
| 2,810,514 | 10/1957 | Patrick | 415/219 C |
| 3,088,416 | 5/1963 | Danis | 415/201 |
| 3,339,831 | 9/1967 | Ranz | 415/206 |
| 3,412,929 | 11/1968 | Greenheck | 415/201 |
| 3,619,080 | 11/1971 | Bullock | 415/206 |
| 3,627,442 | 12/1971 | Brandt | 415/219 |
| 3,653,116 | 4/1972 | Lov et al. | 29/243.52 |
| 3,726,611 | 4/1973 | Astrom | 415/219 C |
| 3,737,966 | 6/1973 | Ranz | 416/178 |
| 3,746,464 | 7/1973 | Goettl | 415/201 |
| 3,874,191 | 4/1975 | Hudson | 415/206 |
| 3,960,527 | 6/1976 | Goettl | 415/219 C |
| 4,035,610 | 7/1977 | Roth | 415/219 C |
| 4,092,088 | 5/1978 | Nemesi | 415/201 |

FOREIGN PATENT DOCUMENTS

| | | | |
|---|---|---|---|
| 468907 | 7/1937 | United Kingdom | 29/513 |

*Primary Examiner*—Robert E. Garrett
*Assistant Examiner*—John T. Kwon
*Attorney, Agent, or Firm*—Richard L. Ward

[57] ABSTRACT

A centrifugal blower assembly is provided which includes an improved blower housing construction wherein a pair of end panels each define a plurality of apertures disposed along a line corresponding to the profile of a blower spiral. An elongated scroll member includes a plurality of tab members spaced along each longitudinal side and extending through the apertures in the pair of end panels for conforming the scroll member to the blower spiral profile. At least a portion of the plurality of tab members are deformed relative to the apertures to maintain a connection between the scroll member and the end panels to form the blower housing. The assembly also provides isolated drive motor and air intake compartments, combined motor mount and support means for blower housing, and access for removing the drive motor from its compartment without removal of any side walls.

1 Claim, 6 Drawing Sheets

CENTRIFUGAL BLOWER ASSEMBLY

BACKGROUND OF THE INVENTION

This invention relates generally to the field of centrifugal blowers. Specifically, the invention is directed to a centrifugal blower assembly including an improved blower housing construction. The centrifugal blower assembly further provides a compartmentalized construction having an air intake compartment physically isolated from a drive motor compartment by the blower housing and with the drive motor mounting structure providing lateral support for the blower housing. The centrifugal blower assembly still further provides for removal of the drive motor from the drive motor compartment without removing any portion of the side walls.

Prior centrifugal blower assemblies have generally included structure where the drive motor is mounted to the scroll of the blower housing as shown in U.S. Pat. No. 3,339,831 issued on Sept. 5, 1967 to Ranz.

Schwarz, in U.S. Pat. No. 2,482,519 issued Sept. 20, 1949, teaches a blower housing having generally square end walls and a flanged two-piece scroll member which is permanently spot welded to the pair of end panels.

Drechsel, in U.S. Pat. No. 2,711,682 issued June 25, 1955, discloses a power roof ventilator having an air intake physically separated from the drive motor. The ventilator unit has a radial discharge and does not include an expansion type blower housing with scroll as described in the instant invention.

Brandt, in U.S. Pat. No. 3,627,442 issued Dec. 14, 1971, discloses a blower housing using threaded fasteners for connecting a pair of end walls to the scroll side wall.

Lov et al, in U.S. Pat. No. 3,653,116 issued Apr. 4, 1972, teach the fabrication of a centrifugal fan housing by forming an interlocking seam between the scroll portion and each of the end walls.

The prior art has thus shown centrifugal blower assemblies which provide for the peripheral intake of supply air, separation of the drive motor from the air intake and various blower housing constructions. There has been no known showing, however, of the centrifugal blower assembly of the instant invention where a unique blower housing construction is taught and wherein the blower housing is utilized to effectively divide the overall centrifugal blower assembly into relatively isolated compartments for incoming air and for mounting the drive motor and finally where the drive motor is directly removable from its compartment without disassembly or removal of any portion of the side walls.

SUMMARY OF THE INVENTION

It is therefore an object of the instant invention to provide an improved centrifugal blower assembly.

It is a further object of the instant invention to provide a unique and improved blower housing construction.

It is a still further object of the instant invention to provide a centrifugal blower assembly having a compartmentalized structure.

It is another object of the instant invention to provide a centrifugal blower assembly wherein the drive motor is removable for servicing without removal of any portion of the side walls.

Briefly, the instant invention achieves these objects in a centrifugal blower housing including first and second substantially flat end panels having a generally rectangular periphery. The end panels each define a plurality of apertures spaced inwardly from the periphery and disposed along a line corresponding to the profile of a blower spiral terminating at a blower exit opening. One of the first or second end panels defines an air inlet opening and the other defines a drive shaft opening. An elongated sheet metal scroll member includes a plurality of tab members spaced along each longitudinal side and extending through the apertures in the first and second end panels for conforming the scroll member to the blower spiral profile. The scroll member and the end panels cooperatively define the blower exit opening. At least a portion of the plurality of tab members are deformed relative to the apertures to maintain a connection between the scroll member and the first and second end panels to form the centrifugal blower housing.

The objects are further achieved through a centrifugal blower assembly which includes the centrifugal blower housing. The blower assembly has a box-like enclosure with a base comprising a bottom wall, a plurality of generally vertical side walls supported on the base, and a cover comprising a top wall supported on the side walls. The blower housing is secured to the base within the blower assembly enclosure and is cooperable therewith to define an air intake compartment and a drive motor compartment on opposite sides of the blower housing which are effectively isolated from each other. The blower assembly enclosure defines an air ingress communicating with the air intake compartment and an air egress communicating with the blower exit opening. Drive motor mounting structure is provided which laterally supports the blower housing on the base and which provides for removal of the drive motor without removal of any portion of the blower assembly side walls.

Details of the centrifugal blower assembly and further objects and advantages thereof will become evident as the description proceeds and from an examination of the accompanying six sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
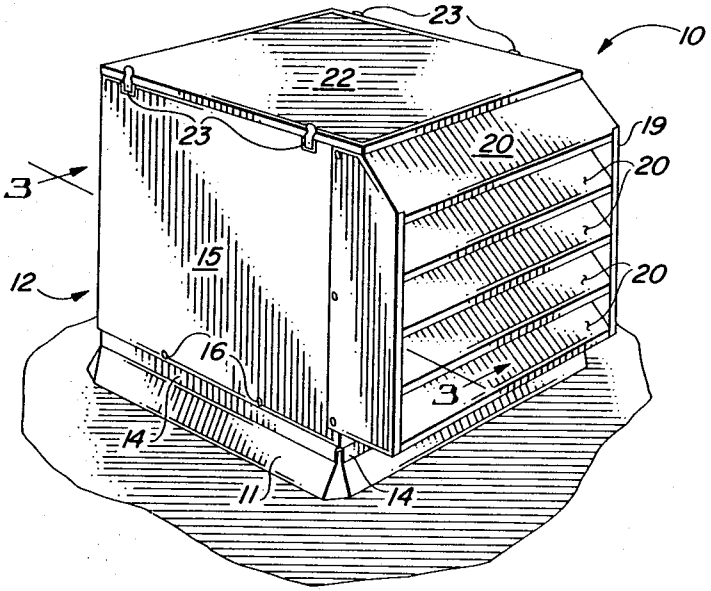
FIG. 1 is a pictorial view of a centrifugal blower assembly including features of the instant invention and operable for supplying air.

Referring now to the drawings, there is shown in FIGS. 1 and 3–8 a preferred embodiment of the instant invention. As best illustrated in FIG. 1, the centrifugal blower assembly 10 comprises a fresh air supply ventilator which is mounted on a built-up rooftop curb 11 and which is operable for supplying fresh air to the interior of a building or to an industrial or cooking ventilating hood, for example.

Figure 3:
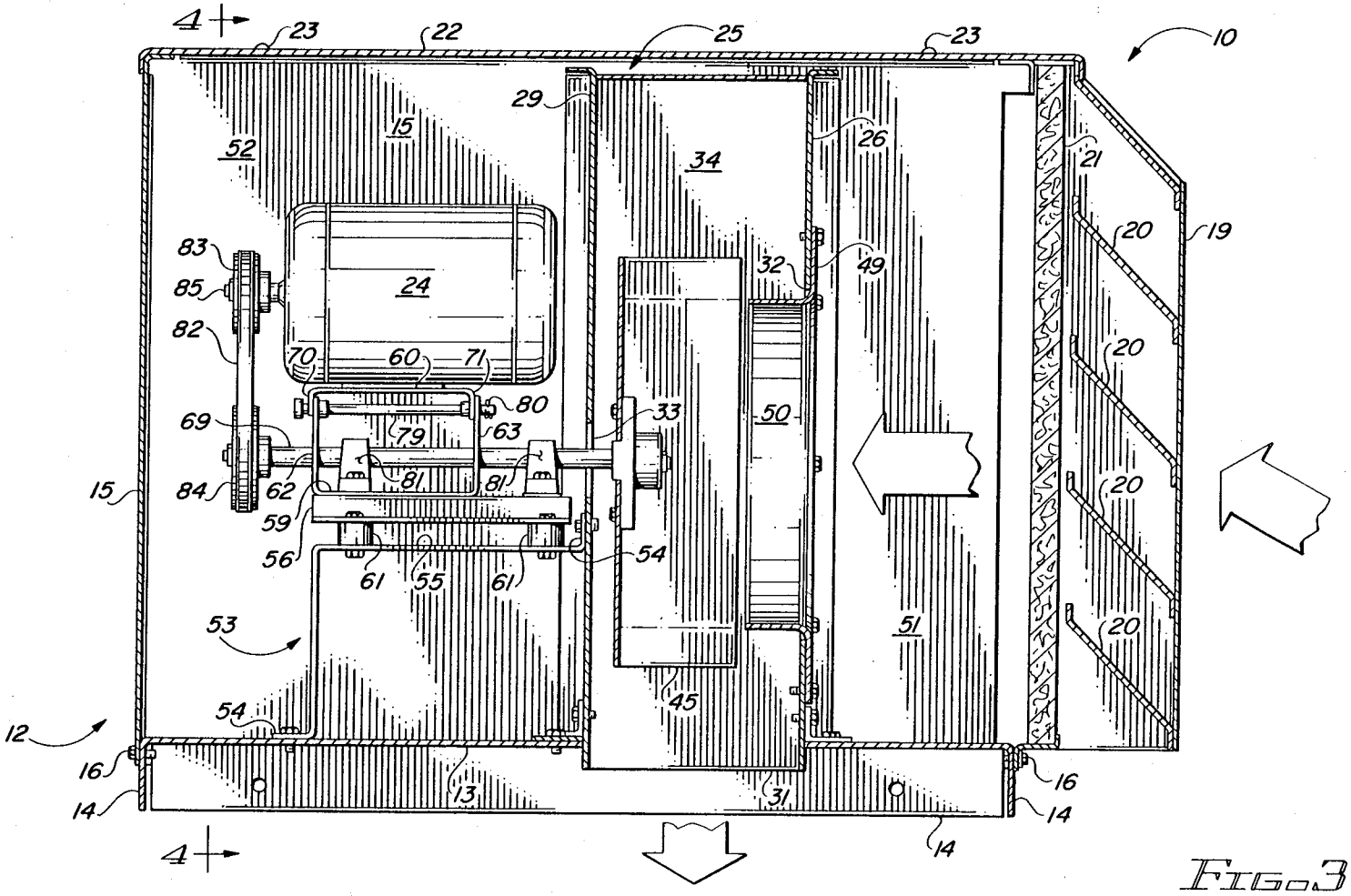
FIG. 3 is a section view taken generally along lines 3—3 of FIG. 1 and showing the construction of the centrifugal blower assembly including a blower housing.

Turning specifically to FIGS. 1 and 3, it can be seen that the centrifugal blower assembly 10 comprises a substantially rectangular box-like structure 12. The box-like structure 12 includes a generally flat, horizontally disposed, base member 13 which has downwardly turned flanges 14 and when installed the base member 13 directly overlies the built-up rooftop curb 11 for mounting the centrifugal blower assembly 10 thereto.

As further shown in FIGS. 1 and 3, the box-like structure 12 also includes a plurality of substantially vertically extending side walls 15 secured to the downturned flanges 14 of the base member 13 by means of mechanical fasteners 16. One end of the box-like structure 12 has a louvered air intake assembly 19. As best shown in FIG. 3, the louvers 20 of the louvered air intake assembly 19 slope downwardly to promote the deflection and drainage of rain and snow away from the louvered air intake assembly 19. Also shown in FIG. 3 is a full length and width filter 21 which is laterally spaced from the louvered air intake assembly 19 within the box-like structure 12 for filtering foreign materials from the incoming fresh air supply.

A removable top cover 22 rests upon the side walls 15 and upon a portion of the air intake assembly 19. The top cover 22 is held in place by a plurality of latches 23 secured to at least two of the side walls 15 as best shown pictorially in FIG. 1. Provision of the removable top cover 22 permits access to within the box-like structure 12 from above for simplified servicing of the drive motor 24 or filter 21.

Figure 4:
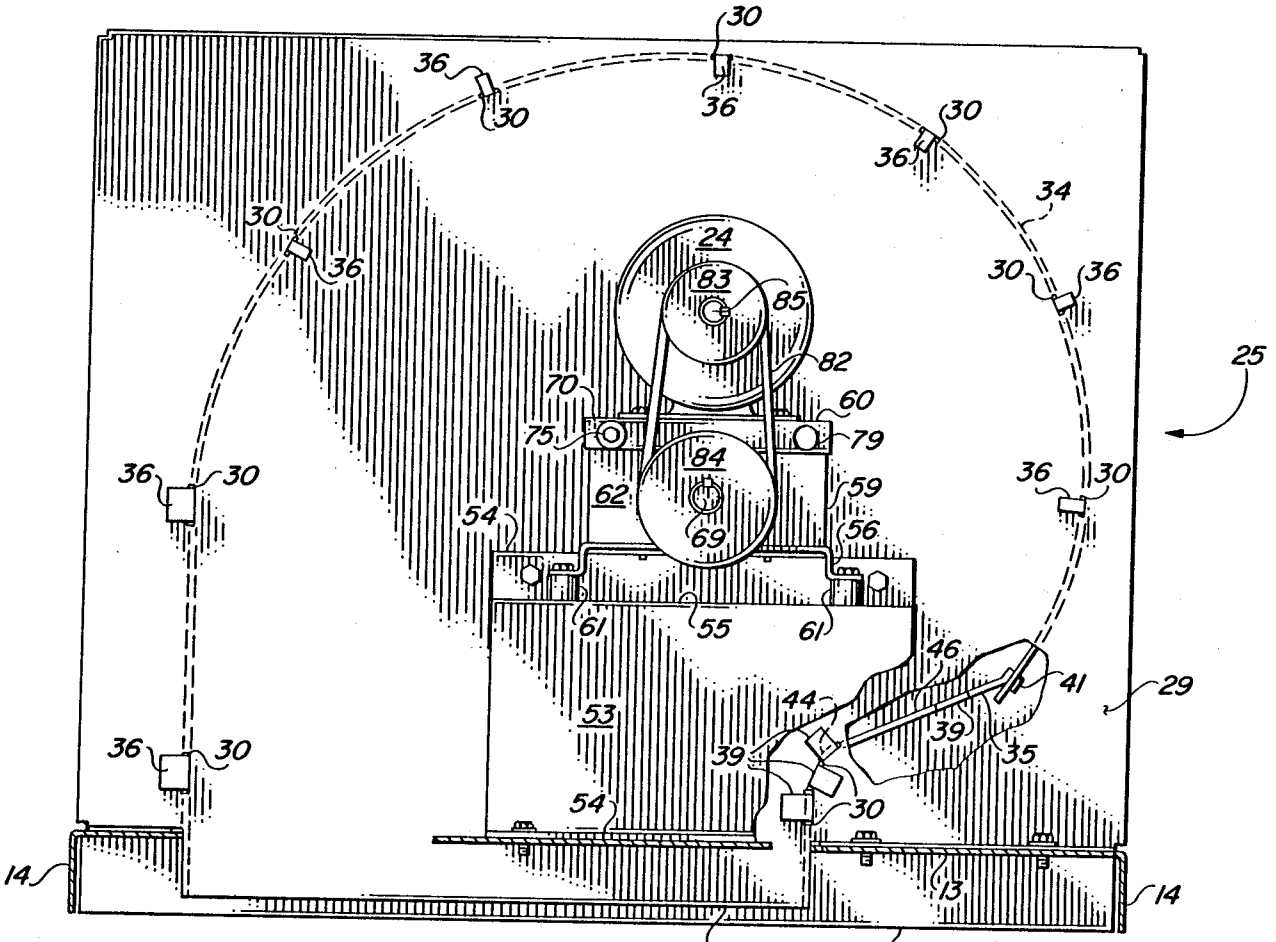
FIG. 4 is a view taken generally along lines 4—4 of FIG. 3 showing the attachment of the scroll member to the end panels and the drive motor mounting system.

Referring again to FIG. 3 and also to FIG. 4, there is shown a blower housing 25 which is operably disposed within the box-like structure 12. The blower housing 25 comprises first and second substantially flat end panels 26 and 29 having a generally rectangular periphery. As best shown in FIG. 4, which shows the blower housing 25 mounted to the base member 13 without the side walls 15 of the box-like structure 12, each of the end panels 26 and 29 include a plurality of apertures 30 spaced inwardly from the periphery and disposed along a line corresponding to the profile of a blower spiral and terminating at a blower exit opening 31. As shown in FIG. 3, the first end panel 26 has an air inlet opening 32 and the second end panel 29 has a drive shaft opening 33.

Figure 5:
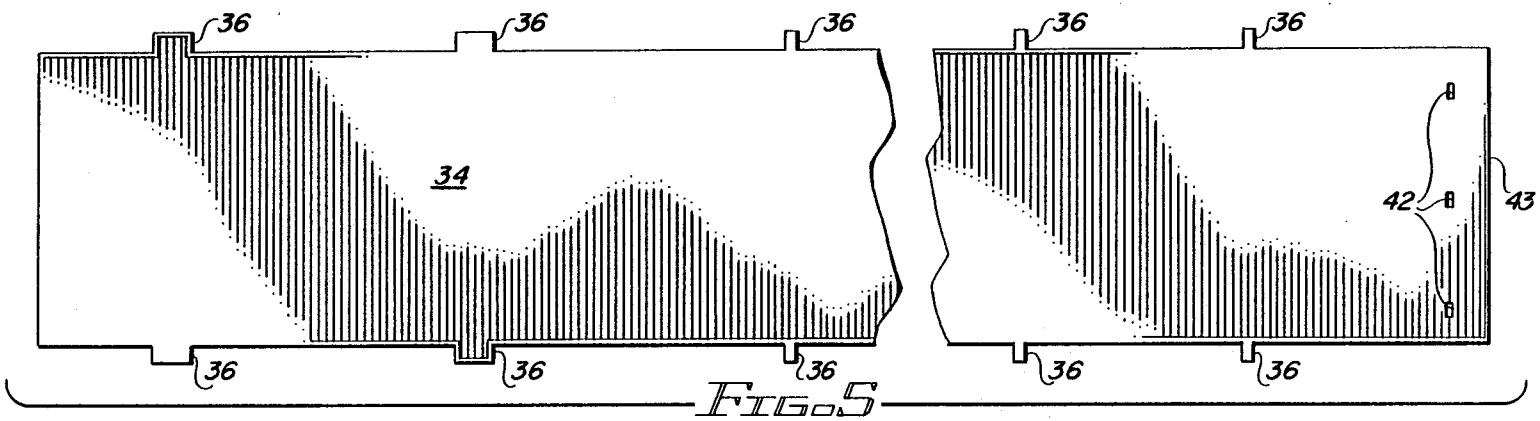
FIG. 5 shows a first portion of the blower scroll before assembly.
Figure 7:
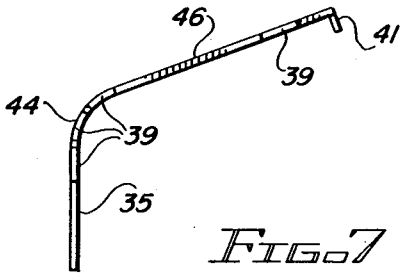
FIG. 7 shows the second portion of the blower scroll of FIG. 6 in the post-formed condition.
Figure 6:
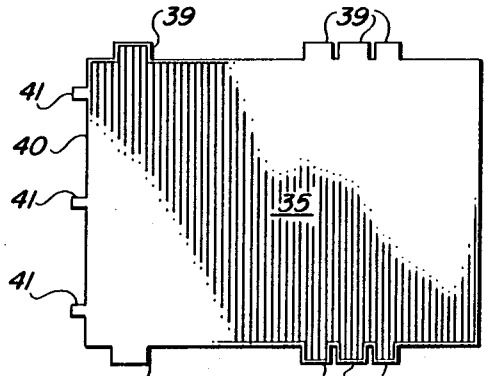
FIG. 6 shows a second portion of the blower scroll prior to forming and prior to assembly.

Turning now to FIGS. 5–7, there are shown first and second scroll members 34 and 35. The first scroll member 34 shown in FIG. 5 is an elongated, generally flat, sheet metal part having a first plurality of tab members 36 spaced along each longitudinal side thereof. The second scroll member 35 is shown in the flat in FIG. 6 and in FIG. 7 it is shown in the formed or ready-to-use condition. As best shown in FIG. 6, the second scroll member 35 includes a second plurality of tab members 39 spaced along each longitudinal side. As further shown in FIG. 6, one transverse end 40 of the second scroll member 35 has a third plurality of tab members 41 which correspond in spacing to apertures 42 in one transverse end 43 of the first scroll member 34. The second scroll member 35 is formed, as in FIG. 7, and then assembled to the first scroll member 34 by inserting the third plurality of tab members 41 through the apertures 42 in the respective transverse ends 40 and 43 and deforming the tab members 41 to maintain a connection therebetween. While the preferred embodiment of the instant invention has shown first and second scroll members 34 and 35, there is no intention to limit the blower housing 25 to this particular configuration. It is contemplated that a single elongated scroll member and other variations thereof could be used.

The blower housing 25 is constructed by assembling the combined first and second scroll members 34 and 35 to one of the first or second end panels 26 or 29 by inserting the tab members 36 and 39 into the apertures 30 to conform the scroll members 34 and 35 to the profile of the blower spiral as best shown in FIG. 4. When the tab members 36 and 39 have been extended through the apertures 30 they are deformed with respect to the end panel 26 or 29 by bending or twisting to maintain a snug relatively airtight connection between the scroll members 34 and 35 and the end panel 26 or 29. The same procedure is utilized to assemble the other end panel 26 or 29 to the scroll members 34 and 35.

As further shown in the cut-away portion of FIG. 4 and also in FIG. 7, the second scroll member 35 forms the air cutoff 44 for the blower wheel 45 and includes a generally flat portion 46 which extends angularly upward and away from the air cutoff 44. The flat portion 46 provides a relatively rapid increase in spacing between the second scroll member 35 and the blower wheel 45. The first scroll member 34 extends spirally from the flat portion 46 and defines a linearly expanding blower spiral with a substantially less rapid increase in spacing between the blower wheel 45 and the first scroll member 34.

FIG. 3 still further shows an air inlet plate 49 which substantially covers the air inlet opening 32 and includes a formed central orifice 50. The central orifice 50 extends inwardly between the end panels 26 and 29 and directs the flow of incoming air into the eye of the blower wheel 45.

FIGS. 3 and 4 further show the blower housing 25 secured to the base member 13 with the blower exit opening 31 directed generally downwardly through the base member 13. As depicted in FIG. 3, the blower housing 25 is laterally spaced from the air intake assembly 19. This location of the blower housing 25 within the box-like structure 12 defines an air intake compartment 51 and a drive motor compartment 52 on opposite sides of the blower housing 25 which are effectively isolated from each other. As still further shown in FIGS. 3 and 4, the end panels 26 and 29 extend substantially the entire width and height of the box-like structure 12 so that there is very minimal air leakage between compartments 51 and 52.

Referring again to FIGS. 3 and 4, there is shown a step-like right angle bracket 53 located within the drive motor compartment 52. This right angle bracket 53 is in supporting contact with the second end panel 29 of the blower housing 25 and with the base member 13 through flanges 54. The right angle bracket 53 provides substantial lateral support to the blower housing 25 and the flat generally horizontal surface 55 provides a mounting surface for the drive motor 24.

Figure 8:
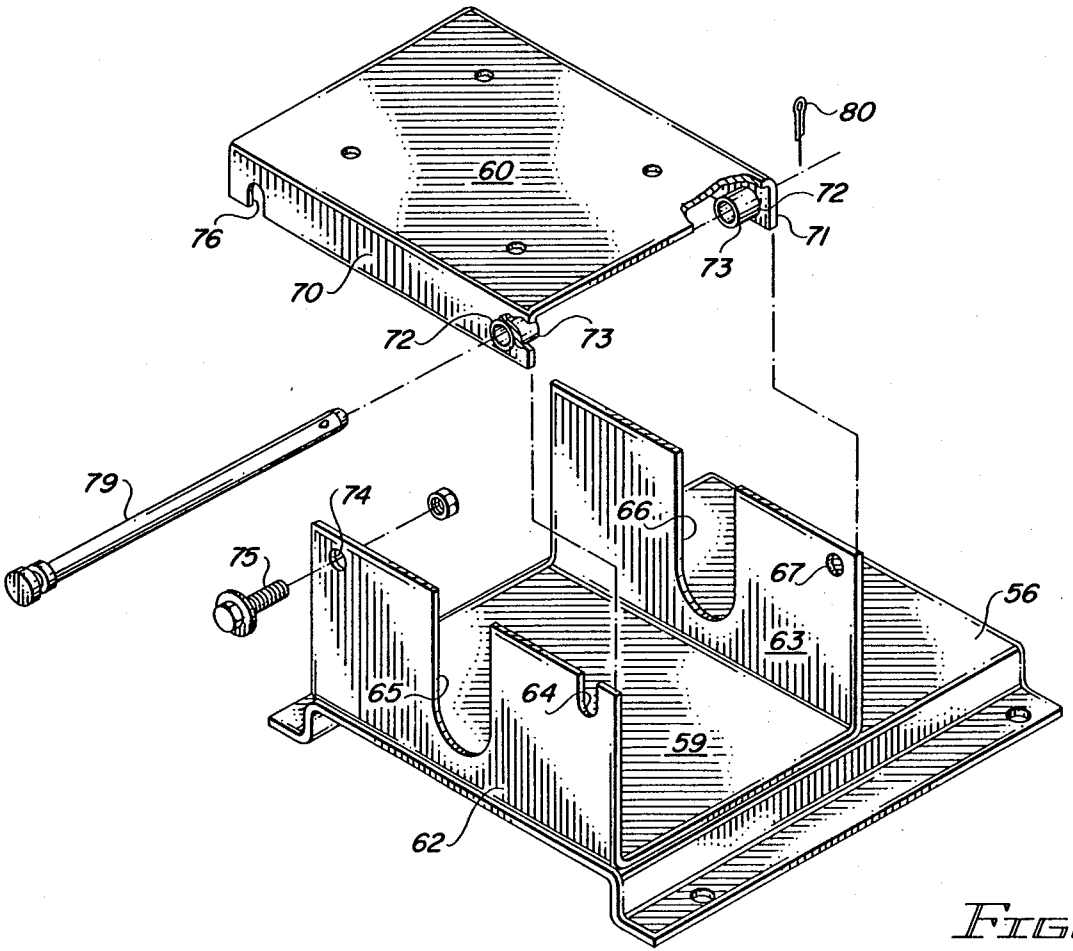
FIG. 8 is an exploded view of the drive motor mounting bracketry.

The drive motor 24 is removably mounted to the horizontal surface 55 through a series of brackets 56, 59 and 60. As shown in FIGS. 3, 4 and 8, a hat section bracket 56 is attached to the horizontal surface 55 and is vibrationally isolated from the right angle bracket 53 by a plurality of elastomeric mounts 61. As further shown in FIGS. 3 and 4, as well as in FIG. 8, a U-shaped bracket 59 is attached to the hat section bracket 56 and includes upwardly extending first and second end flanges 62 and 63. The first end flange 62 includes a first upwardly opening notch 64 and the second end flange 63 has an aperture 67 which is coaxially aligned with the upwardly opening notch 64. As best shown in FIG. 8, the first and second end flanges 62 and 63 each further include second and third upwardly opening notches 65 and 66 providing clearance for a drive shaft 69.

The exploded view of FIG. 8 best illustrates the assembly of a drive motor mounting bracket 60 to the U-shaped bracket 59. The drive motor mounting bracket 60 is of an inverted U-shape with downwardly extending first and second flanges 70 and 71 and is normally attached to the base of the drive motor 24 as in FIGS. 3 and 4. As best shown in FIG. 8, the first and second flanges 70 and 71 of the drive motor mounting bracket 60 include a pair of coaxially aligned apertures 72. These apertures 72 each receive a tubular bronze bearing 73 which is pressed into the apertures 72 from between the first and the second flanges 70 and 71 as best shown in FIG. 8.

FIG. 8 also shows an aperture 74 in the left side of the first flange 62 of the U-shaped bracket 59 for receiving a suitable fastener 75. The corresponding first flange 70 of the drive motor mounting bracket 60 has a downwardly opening notch 76 which is engageable with this fastener 75 when the drive motor 24 is in the operating posture of FIGS. 3 and 4.

A pivot pin 79 extends through the coaxially aligned bearings 73. The drive motor mounting bracket 60 is pivotally assembled to the U-shaped bracket 59 by engaging the bearing 73 associated with the first flange 70 of the drive motor mounting bracket 60 within the upwardly opening notch 64 of the first flange 62 of the U-shaped bracket 59 and engaging the downwardly opening notch 76 with the fastener 75. The assembly is completed by axially aligning the bearing 73 associated with the second flange 71 of the drive motor mounting bracket 60 with the aperture 67 in the second flange 63 of the U-shaped bracket 59 and axially moving the pivot pin 79 through the aperture 67. The pivot pin 79 is axially retained by a cotter pin 80 or other fastening device and the fastener 75 is tightened to lock the first flange 70 of the drive motor mounting bracket 60 to the first flange 62 of the U-shaped bracket 59.

The drive motor 24 and drive motor mounting bracket 60 can be pivoted on the bearings 73 and pivot pin 79 by loosening the fastener 75. This mounting arrangement will allow the removal of the drive motor 24 and the drive motor mounting bracket 60 from the drive motor compartment 52 by removing only the top cover 22. This is accomplished by releasing or loosening the fastener 75, removing the cotter pin 80 and axially withdrawing the pivot pin 79 a fractional portion of its length so that the end of the pivot pin 79 clears the aperture 67 in the second flange 63 of the U-shaped bracket 59. This simple operation will allow the drive motor 24 and the drive motor mounting bracket 60 to be lifted off the U-shaped bracket 59 and removed from the drive motor compartment 52 with the pivot pin 79 retained by the bearings 73

As further indicated in FIG. 3, the blower wheel 45 is operably disposed within the blower housing 25. The blower wheel 45 is attached to the drive shaft 69 which extends generally horizontally through the drive shaft opening 33 in the end panel 29 and into the drive motor compartment 52. The drive shaft 69 is supported for rotation between a pair of pillow block bearings 81 which are mounted on the hat section bracket 56. The drive motor 24 is drivingly connected to the drive shaft 69 by means of a drive belt 82 and a pair of drive pulleys 83 and 84 attached to the drive motor shaft 85 and drive shaft 69 respectively.

Figure 2:
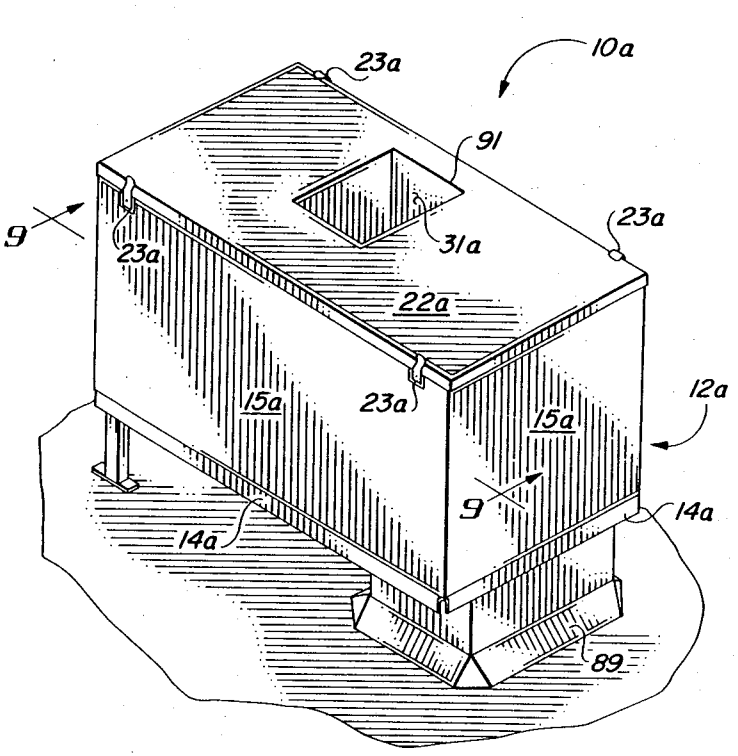
FIG. 2 is a pictorial view of an alternate centrifugal blower assembly including features of the instant invention and operable for exhausting air.
Figure 9:
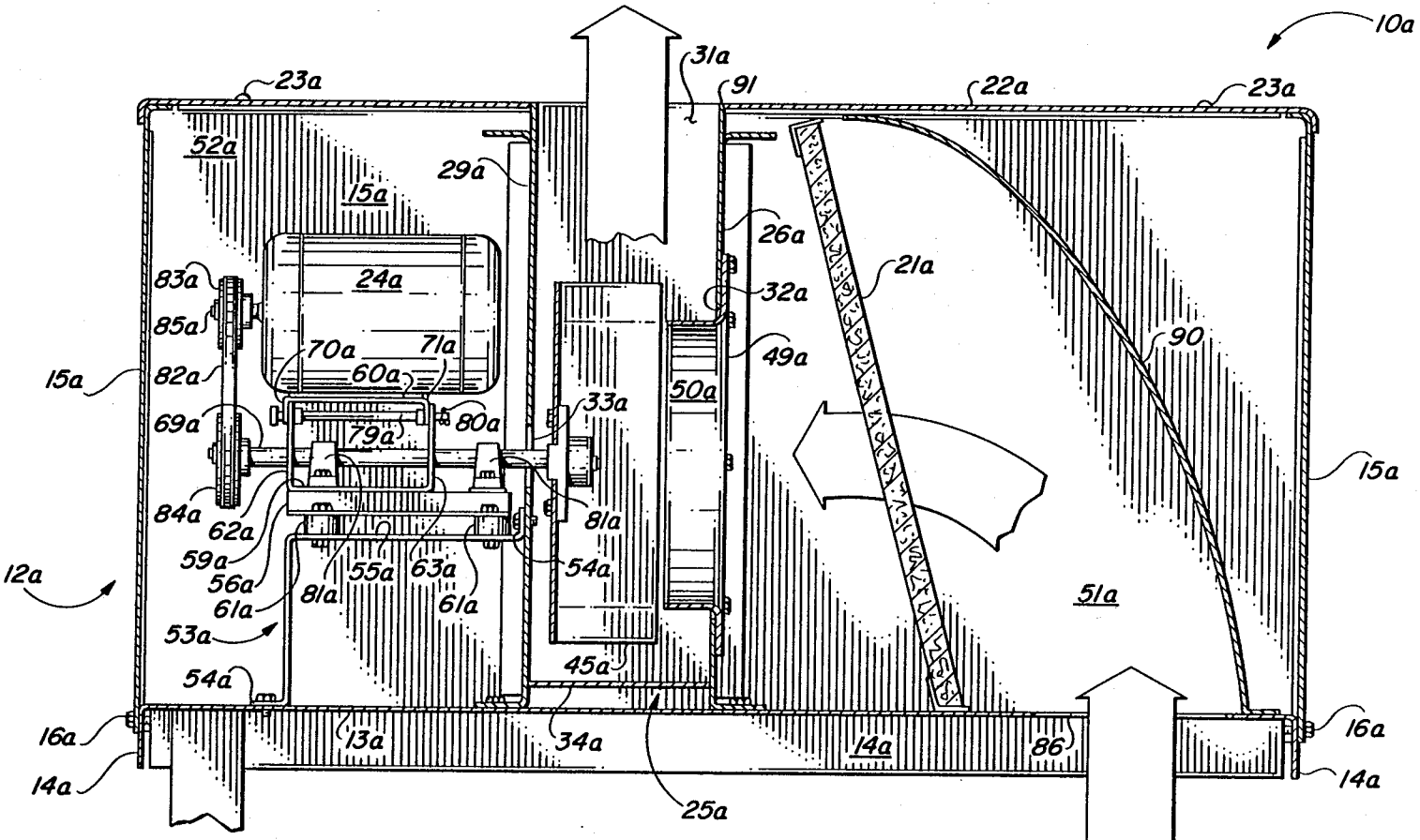
FIG. 9 is a view taken generally along lines 9—9 of FIG. 2 showing the interior construction of the alternate blower assembly including the instant invention.

Turning now to the alternate embodiment of FIGS. 2 and 9, there is shown an exhaust ventilating embodiment of the present invention with similar components identified by numerals used with the embodiment for supplying air and the suffix "a". In this alternate centrifugal blower assembly, the base member **13*a* has been lengthened somewhat to provide an air inlet 86 in airflow communication with a rooftop curb 89 for withdrawing exhaust air from a structure. The air intake compartment 51*a* includes an airflow guide baffle 90 and an optional filter 21*a*** for extracting grease and foreign objects.

In this alternate centrifugal blower assembly the blower housing **25*a* has been rotated 180° about its rotational axis from the position shown in FIGS. 3 and 4 so that the blower exit opening 31*a* is directed upwardly through the top cover 22*a* which includes an opening 91 in airflow communication with the blower exit opening 31*a*. Although not shown in FIGS. 2 and 9, it is anticipated that opening 91 would include an outlet cover for preventing rain and snow from directly entering the opening 91** as well as a screen for excluding insects, birds and small animals. It is noted that substantially all other construction details are the same as those previously described herein relating to the preferred embodiment of the instant invention.

There has thus been defined herein an improved centrifugal blower assembly having a new and novel blower housing construction and a compartmentalized structure which provides for effectively isolating the air intake compartment from the drive motor compartment. The improved centrifugal blower assembly further provides drive motor mounting structure which laterally supports the blower housing on the base member and which provides for removal of the drive motor without removal of any portion of the blower assembly side walls.

In the drawings and specification, there has been set forth a preferred embodiment of the invention and although specific terms are employed, these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

We claim:

1. A centrifugal blower assembly, comprising: a box-like blower assembly enclosure including base means comprising a bottom wall, a side wall assembly comprising a plurality of generally vertical side walls supported on said base means, and removable cover means comprising a top wall supported on said side walls;

blower housing means secured to said base means within said blower assembly enclosure and including first and second substantially flat end panels having a generally rectangular periphery, said end panels each defining a plurality of apertures spaced inwardly from said periphery and disposed along a line corresponding to the profile of a blower spiral and terminating at a blower exit opening, one of said end panels defining an air inlet opening and the other defining a drive shaft opening, and elongated sheet metal scroll means substantially free of side flanges and including a plurality of tab members spaced along each longitudinal side, said tab members extending through said apertures in said end panels with said scroll means disposed along said blower spiral profile, at least a portion of said plurality of tab members being deformed relative to said apertures to maintain a connection between said scroll means and said end panels to form said blower housing means, said scroll means and said end panels cooperatively defining said blower exit opening; means in said blower assembly enclosure defining an air ingress communicating with said air intake compartment and an air egress communicating with said blower exit opening; drive motor mounting means including structural means connected to said end panel having said drive shaft opening and to said base means for laterally supporting said blower housing means and further including bracket means defining a motor mounting surface; a drive motor mounted on said motor mounting surface; a blower wheel operably disposed in said blower housing means; means for drivingly connecting said drive motor to said blower wheel including a drive shaft extending through said drive shaft opening; and means for pivotally connecting said bracket means to said structural means, said means for pivotally connecting including a pivot member axially movable a fractional portion of its length from a first operating posture to a second disengaged posture for permitting removal of said drive motor without removing any portion of said side wall assembly from said base means.

* * * * *